US006142388A

United States Patent [19]

Schwab

[11] Patent Number: 6,142,388

[45] **Date of Patent: *Nov. 7, 2000**

[54] ATOMIZING NOZZLE

[75] Inventor: James J. Schwab, Napa, Calif.

[73] Assignee: EnviroCare International, Inc., Novato, Calif.

[ * ] Notice: This patent is subject to a terminal disclaimer.

[21] Appl. No.: 09/211,690

[22] Filed: Dec. 14, 1998

Related U.S. Application Data

[62] Division of application No. 08/700,878, Aug. 21, 1996, Pat. No. 5,848,750.

[51] Int. Cl.[7] ..... B05B 7/06; B05B 7/10

[52] U.S. Cl. ..... 239/405; 239/590.5; 239/432

[58] Field of Search ..... 239/459, 460, 239/405, 403, 518, 524, 590.5, 553.5, 432

[56] References Cited

U.S. PATENT DOCUMENTS

| | | | |
|---|---|---|---|
| 2,118,943 | 5/1938 | Price et al. | 239/460 X |
| 2,936,960 | 5/1960 | Thompson | 239/460 X |
| 3,116,018 | 12/1963 | Kunz | 239/460 X |
| 3,387,791 | 6/1968 | Allenbaugh | 239/460 X |
| 3,693,886 | 9/1972 | Conrad | 239/524 X |
| 4,129,257 | 12/1978 | Eggert | 239/460 X |
| 4,392,618 | 7/1983 | Evans et al. | 239/461 |
| 5,848,750 | 12/1998 | Schwab | 239/405 |

*Primary Examiner*—Kevin Weldon
*Attorney, Agent, or Firm*—Coudert Brothers

[57] ABSTRACT

A two-fluid atomizing nozzle incorporating a novel nozzle cap is described. The nozzle cap comprises support spokes which couple a pintle to the outer frame of the nozzle cap for holding the pintle in position. The support spokes comprise dams which prevent liquid from flowing along the length of the support spokes to the outer frame of the nozzle cap. This improves atomization by causing any liquid which flows along the spokes to reenter the high disturbance region of the nozzle. Additionally, it reduces erosion of the support spokes, particularly near the end of the spokes adjacent to the outer frame of the nozzle cap. Moreover, it reduces erosion of the interior wall of the outer frame of the nozzle cap. In another embodiment the support spokes have a non-planar inlet surface to improve atomization and to reduce erosion of the support spokes and the interior wall of the outer frame.

32 Claims, 4 Drawing Sheets

ATOMIZING NOZZLE

This is a divisional application of application Ser. No. 08/700,878, filed Aug. 21, 1996, now U.S. Pat. No. 5,848,750, which issued Dec. 15, 1998.

FIELD OF THE INVENTION

The present invention relates to atomizing nozzles. More specifically, the present invention relates to two-fluid atomizing nozzles incorporating a nozzle cap to assist in the creation of a spray of fine droplets of a liquid.

BACKGROUND OF THE INVENTION

In many applications it is desirable to produce a spray of fine droplets of a liquid. Such a spray may be used, for example, to cool and cleanse process exhaust gases that are hot and possibly laden with particles and contaminant gases. A two-fluid nozzle atomizes a liquid with a pressurized gas as the liquid is ejected out of the nozzle. The atomized liquid spray from the two-fluid nozzle may be mixed with and thereby cool a process effluent gas. While the nozzle of the present invention is described in connection with the applications of cooling and cleansing process gases, those skilled in the art will appreciate that the nozzle may be used in many applications requiring a fine spray of liquid droplets.

One especially advantageous design of a two-fluid nozzle of the prior art, utilizes a nozzle cap to assist in the production of liquid droplets. An example of the prior art nozzle cap is shown in FIG. 10. FIG. 10 shows a rear perspective view of a prior art nozzle cap 1000, which was used in connection with a nozzle of the type shown in FIG. 1. The nozzle cap 1000 includes an outer frame 1005, a pintle 1010 and support spokes 1015 to support and couple the pintle 1010 to the outer frame 1005. The pintle 1010 comprises an inlet splash plate 1020, a tapered shaft 1025 and an outlet deflector plate (not shown).

The prior art nozzle cap 1000 suffered from several limitations. One limitation of the prior art nozzle cap is its inability to fully atomize some of the liquid. During the atomization of a liquid, the liquid from a liquid feed tube (shown in FIG. 2) strikes the inlet splash plate 1020, forming a thin liquid film. The compressed gas from the high pressure gas source (not shown) creates a turbulent condition near the inlet splash plate. As a result of the turbulent condition at the inlet splash plate, a substantial portion of the liquid from the liquid film flows off of the splash plate 1020, enters the venturi 1030 and exits the nozzle cap 1000 as finely atomized liquid. However, some of the liquid does not enter the venturi 1030 in the turbulent region. Instead, it flows along the support spokes 1015. Most of the liquid flowing along the support spokes 1015 flows off of the spokes near their ends 1040, far from the turbulence near the inlet splash plate and, therefore, does not enter the turbulent region. Consequently, it does not exit the nozzle as fine droplets. Instead, it runs down the interior wall 1035 of the outer frame 1005 and exits the nozzle as coarse droplets. This degrades atomization of the liquid.

The limited atomization is worsened as the liquid film at the inlet splash plate 1020 is improved, ie., reduced in thickness via increased velocity of the liquid exiting the feed tube and the consequent increased radial velocity of liquid flowing radially on the inlet splash plate. An improved liquid film is highly desirable as it results in the production of finer water droplets. However, reducing the thickness of the liquid film at the inlet splash plate 1020 increases the probability of the liquid bypassing primary atomization and exiting the nozzle as coarse droplets. This limits the ability to improve the liquid film.

A second limitation of the prior art nozzle cap 1000 is that the flow of liquid along the spokes and the interior wall 1035 of the outer frame 1005 causes erosion of the support spokes and the interior wall 1035 of the outer frame 1005. As more liquid flows along the support spokes 1015 to the outer frame 1005 of the nozzle cap 1000, without being atomized along the way, there is greater exposure of the support spokes 1015 to the liquid. The flow of liquid along the support spokes 1015, which are generally made of metal, causes them to erode. This erosion tends to be most severe near the end 1040 of the support spokes 1015 closest to the outer frame 1005 of the nozzle cap 1000, where the liquid flows off of the spokes. Eventually, the support spokes 1015 may become so severally eroded that they become detached from the outer frame 1005 of the nozzle cap 1000 and no longer support the pintle 1010, destroying the nozzle cap. Therefore, the liquid flowing along the support spokes 1015 directly contributes to more rapid erosion of the support spokes 1015 and the consequential shorter operational lifetime of the nozzle cap 1000. Similarly, liquid flowing along the interior wall 1035 of the outer frame 1005, which is also usually made of a metal, causes erosion of the interior wall 1035 and degradation of the nozzle cap 1000.

SUMMARY OF THE INVENTION

The present invention covers an improved atomizing nozzle. The nozzle of the present invention uses a nozzle cap comprising dams disposed on the inlet surface of the support spokes that connect the pintle to the outer frame of the nozzle cap. The dams improve the performance of the nozzle and reduce erosion of the support spokes and the interior wall of the outer frame by preventing water from flowing along the spokes beyond the dams. Unlike the atomizing nozzle of the prior art, the liquid that flows along the support spokes does not run along the entire length of the support spokes to the outer frame of the nozzle cap. Instead, it is obstructed by the dams. Upon collision with the dams, the liquid film flows off of the spokes and into the turbulent region in the venturi where it is atomized into fine droplets. Therefore, the use of dams improves atomization of the liquid and reduces the amount of liquid which flows to the outer frame of the nozzle cap and exits the nozzle as coarse droplets. This in turn reduces erosion of (i) the interior wall of the outer frame and (ii) the support spokes, which in the prior art systems tended to erode most severely near the end closest to the outer frame of the nozzle cap.

In another embodiment of the invention, nozzle caps having support spokes with non-planar inlet surfaces are used to improve atomization and to reduce erosion of the support spokes and the interior wall of the outer frame. The non-planar surface decreases liquid flow along the entire length of the support spokes and on the interior wall of the outer frame thereby reducing the erosion of the support spokes and the interior wall. Support spokes having non-planar inlet surfaces that reduce flow of liquid along the spokes can be sufficiently effective at solving the problems associated with nozzles of the prior art. Therefore, such support spokes may be used in nozzle caps which do not have dams disposed on the support spokes. They may also be used in combination with dams to further reduce erosion and improve atomization.

Accordingly, it is an object of the present invention to provide a two-fluid nozzle which is efficient in creating fine droplets of a liquid.

It is another object of the present invention to reduce erosion of the support spokes and the inner surface of the outer frame of the nozzle cap due to the flow of liquid along the surface of the support spokes and the inner surface of the outer frame.

These and other objects of the present invention will become apparent to those skilled in the art from the following detailed description of the invention, the accompanying drawings, and the appended claims.

DETAILED DESCRIPTION OF THE DRAWINGS

Figure 1:
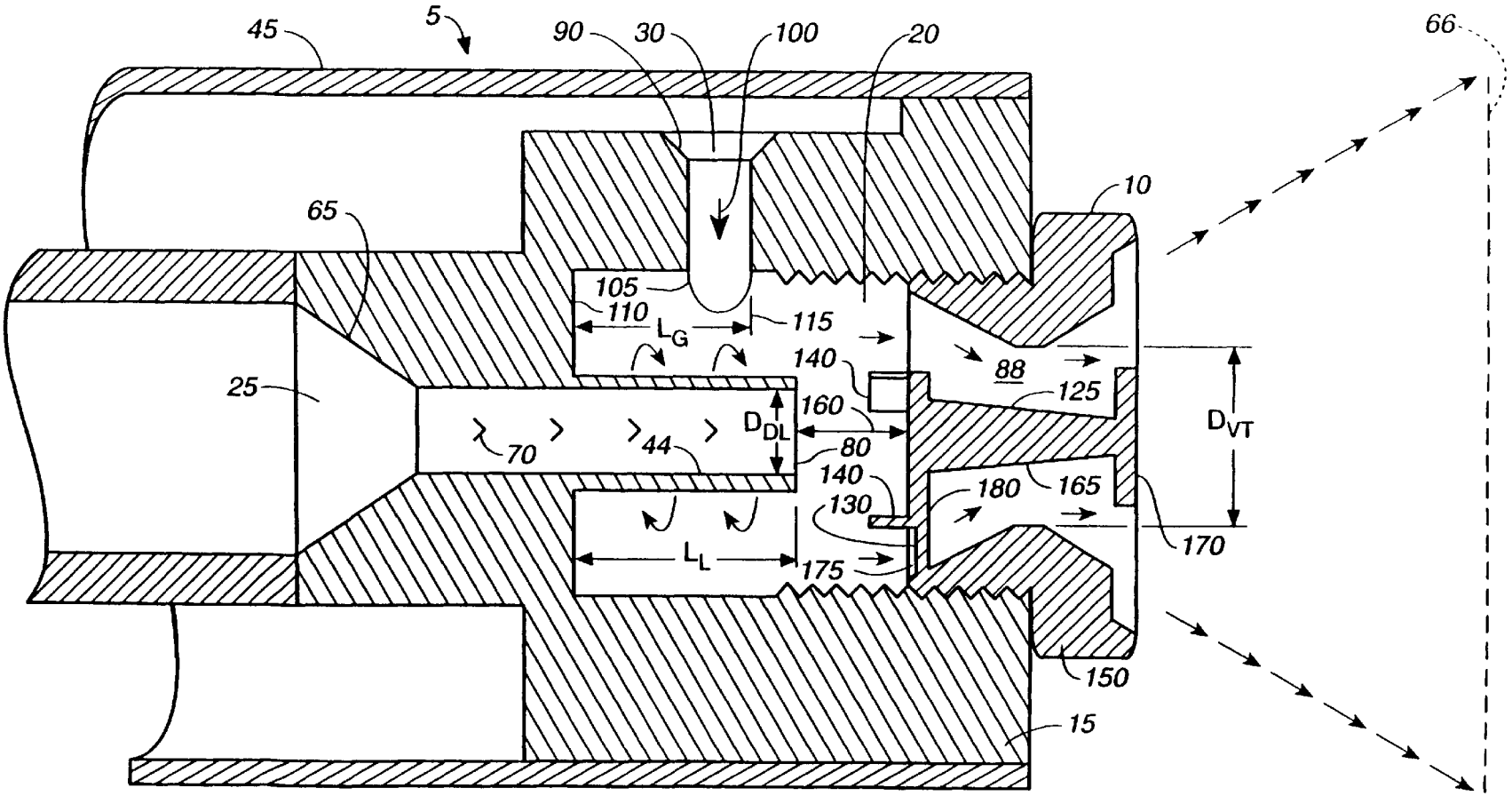
FIG. 1 is a cross sectional view of an atomizing nozzle incorporating a nozzle cap of the present invention.

FIG. 1 shows a cross sectional view of a two-fluid atomizing nozzle 5 of the present invention. The atomizing nozzle shown in FIG. 1 includes a body 15, a chamber 20, a liquid feed tube 25, a tangential gas inlet 30 and a nozzle cap 10. The outer frame 40 of the body 15 is connected, e.g., welded, to the high pressure gas pipe 45. The chamber has a base 50 and an outlet. The liquid feed tube 25 has a tapered section 65 for efficiently dropping the pressure and increasing the velocity of the liquid 70, such as water, introduced into the liquid feed tube 25 from a high pressure liquid source (not shown). Moreover, the liquid feed tube 25 is centrally aligned and extends a length $L_L$ longitudinally within the chamber 20. The liquid 70 introduced into the liquid feed tube 25 exits the tube at the discharge plane 80. The tangential gas inlet tube 30 also has a tapered section 90 for efficiently lowering the pressure and increasing the velocity of the gas 100 introduced into the tangential gas inlet tube 30 from a high pressure gas source (not shown). The gas 100 introduced into the tangential gas inlet tube 30 exits the tube at the gas exit surface 105. As shown in FIG. 1, the distance from the chamber base 110 to the outer point 115 of the gas exit surface 105 is a length $L_G$, which is shorter than the length $L_L$. The gas 100 from the tangential gas inlet tube 30 is discharged above the portion of the liquid feed tube projecting into the chamber so that it fully encircles the projecting portion of the liquid feed tube 25. If the gas was, for example, discharged at a point directly above the discharge point of the liquid, then it may deflect the course of the liquid and hinder the proper operation of the nozzle.

The nozzle cap 10 includes a pintle 125, support spokes 130, dams 140 disposed on the support spokes 130, and an outer frame 150. The pintle 125 includes an inlet splash plate 155, which is a predetermined minimum distance 160 from the discharge plane 80 of the liquid feed tube 25, a tapered shaft 165 coupled to the inlet splash plate 155, and an outlet deflector plate 170 coupled to the tapered shaft 165. The outer frame 150 of the nozzle cap 5 in FIG. 1 is annular. Moreover, the pintle is axially disposed in the annular outer frame 150. The support spokes 130 have an inlet surface 175 and an outlet surface 180 and support the pintle 125 by coupling it to the outer frame 150. Finally, dams 140 are disposed essentially normal to the inlet surface 175 of the support spokes 145.

During the normal operation of the nozzle, liquid from the high pressure source (not shown) flows in the liquid feed tube 25 including the projecting tube 44 and exits the projecting tube 44 at the discharge plane 80. Gas from a high pressure gas source flows in the tangential gas inlet tube 30 and exits the tube at the gas exit surface 105. The liquid that exits the projecting tube 44 strikes the inlet splash plate 155, flows radially outward to form a thin film, and then mixes with the gas. The atomized liquid flows through the venturi 88 and exits the nozzle cap 10 in a spray cone 66, whose angle is determined by the geometry of the outlet deflector plate 170. Some of the liquid that strikes the inlet splash plate 155 does not immediately enter the venturi 88. Instead, it flows along the support spokes 130 strikes the dams 140 and is reintroduced into the venturi 88 after colliding with the dams 140. Thus, use of the dams 140, that were not present in the prior art nozzle caps, such as nozzle cap 1000 shown in FIG. 10, prevents the liquid from flowing to the outer frame 150 of the nozzle cap 10 and exiting the atomizing nozzle 5 as coarse droplets. It also reduces the erosion of the support spokes 130 and the interior wall 135 of outer frame 150 by reducing the flow of liquid on the support spokes 130 and the interior wall 135.

Figure 2:
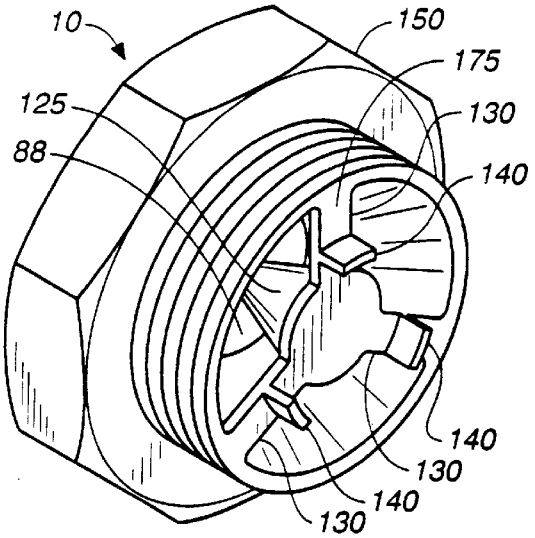
FIG. 2 is a rear perspective view of a nozzle cap of the present invention.

FIG. 2, a rear perspective view of a nozzle cap 10 of the present invention, shows the components of the nozzle cap in greater detail. As can be seen in FIG. 2 nozzle cap 10 includes pintle 125, an outer frame 150 and support spokes 130 coupling the pintle 125 to the outer frame 150 and supporting the pintle 125. Disposed on the inlet surface 175 of the support spokes 130 are dams 140. As described, the dams 140 prevent liquids films on the inlet surface 175 of the support spokes 130 from (i) flowing to the outer frame 150 of the nozzle cap 10, (ii) flowing on the interior surface 135 of the outer frame 150, and (iii) exiting the nozzle as large liquid droplets. Instead, as the liquid film flows along the support spokes 130 it collides with the dams 140 and re-enters the high turbulence area in the venturi 88 where they are atomized by the high pressure gas.

As can be seen in FIG. 2, the dams 140 preferably extend the full width $W_S$ of the support spokes 130 upon which they are disposed. Therefore, the dams 140 have a width $W_D$ equal to $W_S$, the width of the support spokes 130 upon which they are disposed. Moreover, in one useful embodiment, the distance $D_D$ that the dams 140 extend above the inlet surface 175 of the support spokes 130 is equal to one half the inside discharge diameter length $D_{DL}$ of the liquid feed tube 25 (shown in FIG. 1).

FIG. 2 also shows the nozzle cap 10 comprising three dams 140 and three support spokes 130, where one dam is disposed on one corresponding support spoke. Although FIG. 2 shows the nozzle cap 10 as having only three support spokes 130, the present invention may be modified such that there are more or less than three spokes coupling the pintle to the outer frame. Thus, in another embodiment of the invention, there may be two, four, or some other number of support spokes supporting the pintle. Moreover, although FIG. 2 shows only one dam disposed on each support spoke, the present invention may be modified such that there is more than one dam disposed on each support spoke. Thus, in another embodiment, there may be two or three dams disposed on each support spokes. Finally, as shown in FIG. 2 dams 140 comprise an essentially planar surface which is disposed essentially normal to the inlet surface 175 of the support spokes 145. However, the dams 140 need not be normal to the inlet surface to practice the invention nor must they be planar. Therefore, in another embodiment of the invention, the angle between the dams 140 and the inlet surface 175 can be an acute angle instead of a right angle. In yet another embodiment, the angle may be an obtuse angle that is not substantially greater than ninety degrees.

Figure 3:
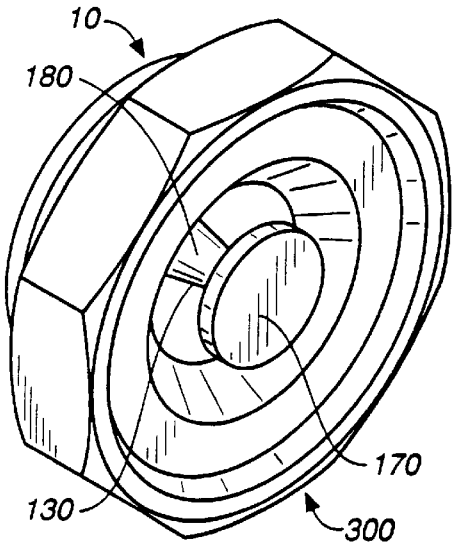
FIG. 3 is a front perspective view of a nozzle cap of the present invention.

FIG. 3 shows a front perspective view of a nozzle cap of the present invention. Since FIG. 3 is a front perspective view from the outlet side 300 of the nozzle cap 10, the dams 140 disposed on the support spokes 130 can not be seen. However, FIG. 3 provides a view of one of the support spokes 130 showing the outlet surface 180 of the support spoke 130. It also provides a clear view of outlet deflector plate 170, which determines the angle at which the spray cone will be formed.

Figure 4:
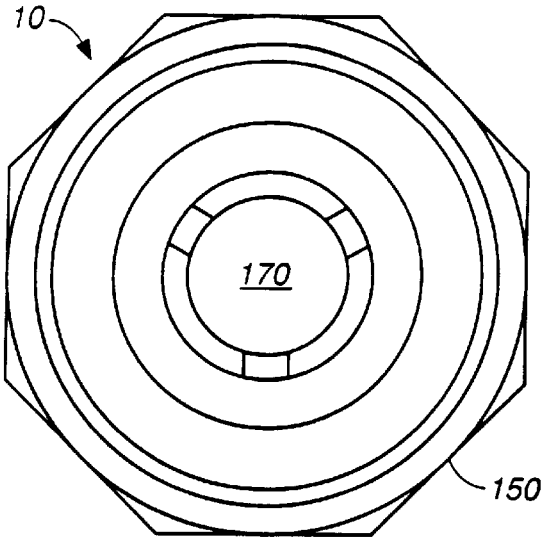
FIG. 4 is a front view of a nozzle cap of the present invention.

FIG. 4 is a front view of a nozzle cap 10 of the present invention. FIG. 4 shows an outlet side 300 view of the outer frame 150 and the outlet deflector plate 170.

Figure 5:
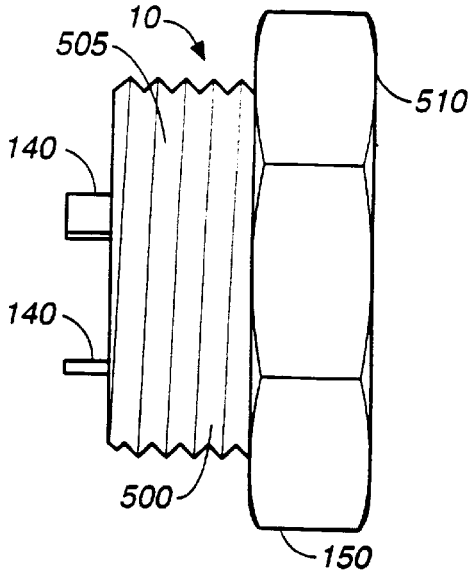
FIG. 5 is a side view of a nozzle cap of the present invention.

FIG. 5 shows a side view of a nozzle cap 10 of the present invention. FIG. 5 provides a clear view of outer frame 150, with screw thread 500 for screwing the nozzle cap 10 to the atomizing nozzle 5 (shown in FIG. 1). Also visible in FIG. 5 are the dams 140 disposed on the support spokes 130 (shown in FIGS. 1–4, 6–7, 8*a* and 9*a*). Although FIG. 5, as well as FIGS. 1 and 2, show the nozzle cap as having screw thread 500, the present invention may be practiced without a screw thread. Thus, in another embodiment of the invention, instead of screw thread 500, the nozzle cap can have a smooth surface which can be attached to the nozzle 5 by any means appropriate for attaching two metals. Preferably, the means for attaching the nozzle cap to the nozzle allows for easy replacement. Moreover, the octagonal outlet portion 510 of the outer frame 150 can in other embodiments be square, hexagonal, cylindrical or some other variation.

Figure 6:
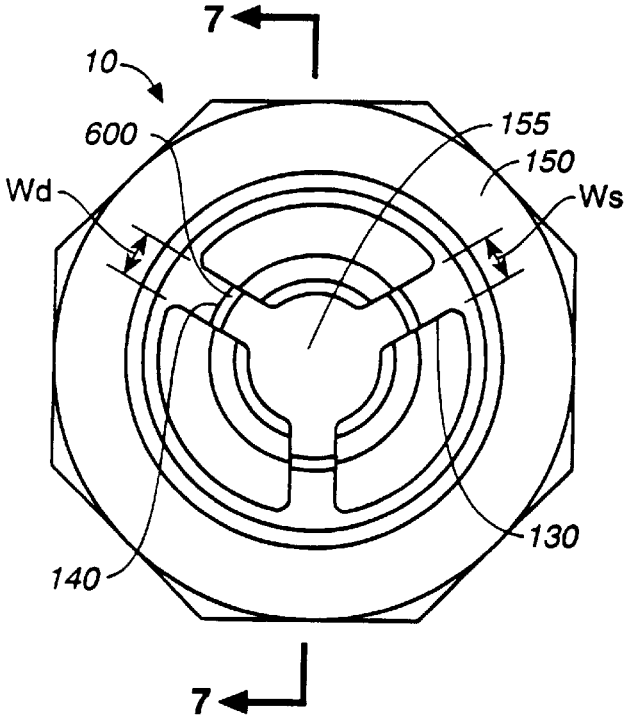
FIG. 6 is a rear view of a nozzle cap of the present invention.

FIG. 6 is a rear view of a nozzle cap of the present invention. In FIG. 6, outer frame 150, support spokes 130, the top portion 600 of dams 140, and inlet splash plate 155 can be clearly seen. In a preferred embodiment, dams 140 are disposed at a distance from the center of the inlet splash plate equal to one half of the interior diameter $D_{VT}$ of the venturi throat. However, in other embodiments, the distance may be less than or greater than one half of $D_{VT}$. Moreover, although as shown in FIG. 6, all the dams 140 are disposed an equal distance away from the inlet splash plate 155, in other embodiments, some or all of the dams can be placed at varying distances from the inlet splash plate 155.

Figure 7:
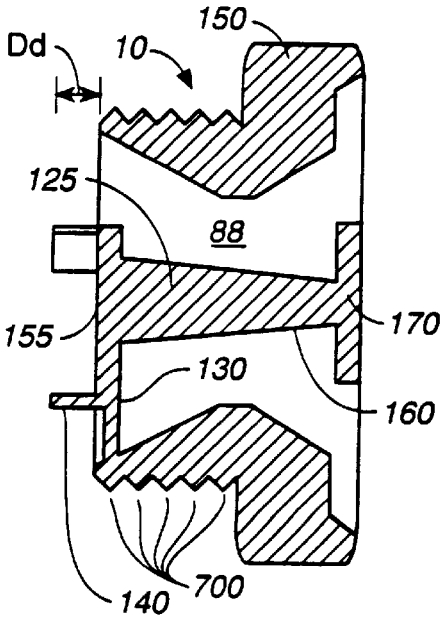
FIG. 7 is a cross sectional view of the nozzle cap of FIG. 6 along line 7—7.

FIG. 7 is a cross sectional view of the nozzle cap of FIG. 6 along line 7—7. FIG. 7 shows a cross sectional view of the outer frame 150, pintle 125, with its inlet splash plate 155, tapering shaft 160 and outlet deflector plate 170. Also visible in FIG. 7 are portions of the dams 140 and support spokes 130. FIG. 7 also shows a cross sectional view of the venturi 88 within the nozzle cap 10. Finally, FIG. 7 shows the teeth 700 of the screw thread 500 (shown in FIG. 5), which in one embodiment of the present invention are used for attaching the nozzle cap 10 onto the atomizing nozzle 5.

Figure 8A:
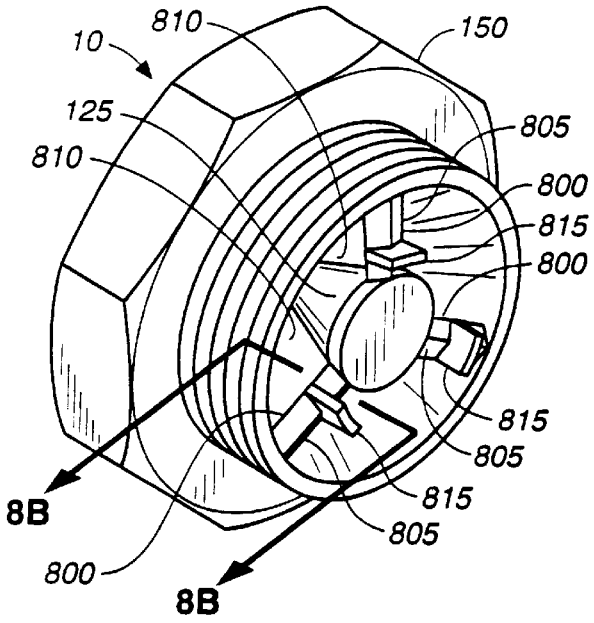
FIG. 8*a* is a rear perspective view of another embodiment of a nozzle cap of the present invention.

FIG. 8*a* shows a rear perspective view of another embodiment of a nozzle cap according to the present invention. In this embodiment, the support spokes 800 have an angular inlet surface 805 rather than a planar inlet surface as shown in FIG. 2. The angular form of the inlet surface 805 increases the likelihood that a liquid film flowing along the support spoke would enter the high turbulence area of the venturi 810 even prior to colliding with dams 815. Thus, use of an angular inlet surface, even without dams disposed on the support spokes, may be sufficiently effective at dealing with the prior art problems of (i) erosion of the support spokes and the interior wall of the outer frame and (ii) non-atomization of a considerable portion of the liquid film flowing along the support spokes.

Figure 8B:
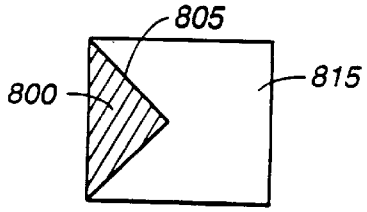
FIG. 8*b* is a cross sectional view taken along line 8*b*—8*b* in FIG. 8*a*.

FIG. 8*b* shows a cross sectional view of support spokes 800 taken along line 8*b*—8*b* in FIG. 8*a*. As can be seen in FIG. 8*b*, the cross section of support spokes 800 is triangular in form.

Figure 9A:
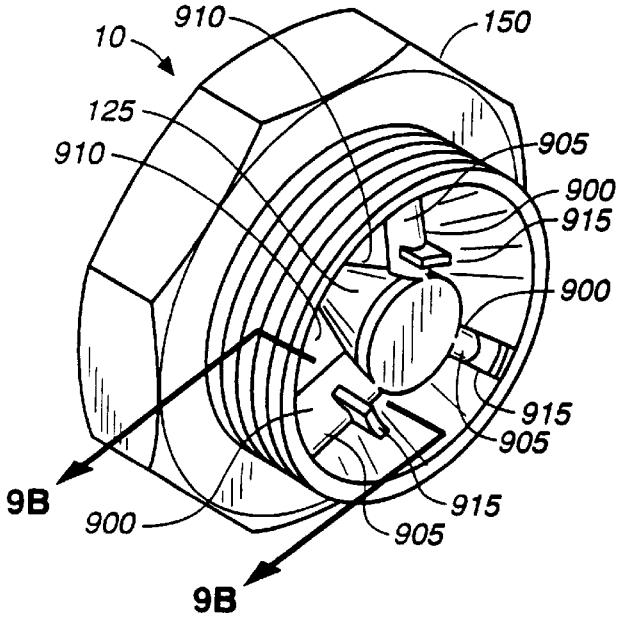
FIG. 9*a* is a rear perspective view of yet another embodiment of a nozzle cap of the present invention.

FIG. 9*a* shows yet another embodiment of a nozzle cap of the present invention. In FIG. 9*a*, the support spokes 900 have an inlet surface 905 that is similar in form to the front side an airfoil. This form, like that shown in FIG. 8*a*, increases the probability that a liquid film flowing along the support spokes 900 would enter the high turbulence area of the venturi 910 without colliding with dams 915. Similar to the embodiment shown in FIG. 8*a*, this embodiment, even without dams disposed on the support spokes, may be sufficiently effective with dealing with the problems of the prior art nozzles.

Figure 9B:
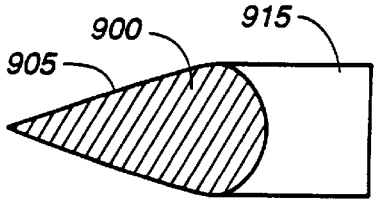
FIG. 9*b* is a cross sectional view taken along line 9*b*—9*b* in FIG. 9*a*.

FIG. 9*b* shows a cross sectional view of the support spokes 900 taken along line 9*b*—9*b* in FIG. 9*a*. As can be seen in FIG. 9*b*, the support spokes have a cross sectional area in the form of an airfoil.

Although FIGS. 8*a* and 9*a* respectively disclose inlet surfaces which are angular and shaped like the front side of an airfoil, those skilled in the art can appreciate that other non-planar inlet surfaces may also be effective at increasing the likelihood that the liquid film flowing along the support spokes would enter the venturi. Similarly, although the above FIGS. 8*b* and 9*b* only disclose support spoke cross sectional areas in the form of a triangle and airfoil, respectively, the present invention may be practiced with support spokes which have a cross sectional area different from the above mentioned cross sectional areas.

Figure 10:
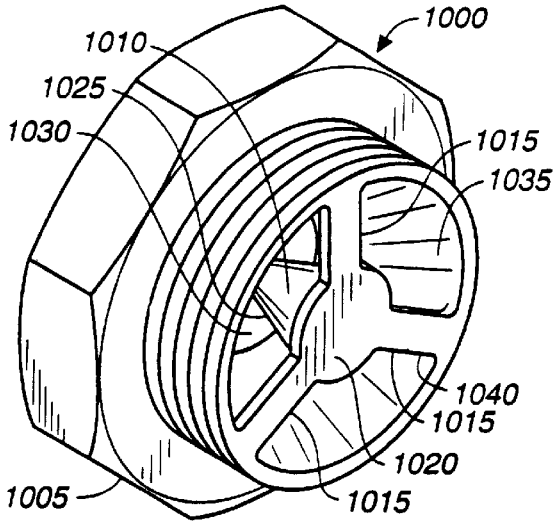
FIG. 10 (PRIOR ART)
FIG. 10 is rear perspective view of a prior art nozzle cap.

FIG. 10 shows a rear perspective view of a nozzle cap 1000 of the prior art, previously described. As can be clearly seen in FIG. 10, there are no dams on the support spokes 1015, which have a planar inlet surface 1050. Therefore an appreciable portion of the liquid flowing along the support spokes 1015 flows along the entire length of the support spokes 1015 to the outer frame 1005 of the nozzle cap 1000. From there it flows along the interior wall 1035 of the outer frame 1005 of the nozzle cap 1000 to the outlet (not shown) where it exits the nozzle cap 1000 as large liquid droplets instead of being sprayed out in the form of fine atomized liquid.

While the present invention has been particularly described with respect to the illustrated embodiments, it will be appreciated that various alterations, modifications and adaptations may be made based on the present disclosure, and are intended to be within the scope of the present invention. While the invention has been described in connection with what is presently considered to be the most practical and preferred embodiments, it is to be understood that the present invention is not limited to the disclosed embodiments but, on the contrary, is intended to cover various modifications and equivalent arrangements included within the scope of the appended claims.

What is claimed is:

1. A nozzle for atomizing a liquid, comprising:

an outer frame;

an inlet splash plate;

at least one support spoke, having an inlet surface and an outlet surface, coupled to said outer frame and said inlet splash plate;

a liquid feed inlet positioned so that a stream of liquid exiting said liquid feed inlet strikes said splash plate; and a gas inlet disposed upstream of said splash plate;

wherein said at least one support spoke is shaped to reduce the flow of liquid to said frame via said at least one support spoke.

2. The nozzle of claim 1, wherein said inlet surface is angular.

3. The nozzle of claim 1, wherein said inlet surface of has a curved surface.

4. The nozzle of claim 1, wherein said inlet surface has a shape similar to an airfoil.

5. The nozzle of claim 1, further comprising at least one dam disposed on said inlet surface.

6. The nozzle of claim 5, wherein said inlet surface is angular.

7. The nozzle of claim 6, wherein said inlet surface has a curved surface.

8. The nozzle of claim 6, wherein said inlet surface has a shape similar to that of an airfoil.

9. The nozzle of claim 1, wherein said outer frame has an inner surface forming a venturi with a venturi mouth adapted to receive atomized liquid from said splash plate.

10. The nozzle of claim 9, wherein said inlet surface is angular.

11. The nozzle of claim 9, wherein said inlet surface has a curved surface.

12. The nozzle of claims 9, wherein said inlet surface has a shape similar to an airfoil.

13. The nozzle of claim 9, further comprising at least one dam disposed on said inlet surface.

14. The nozzle of claim 13, wherein said inlet surface is angular.

15. The nozzle of claim 13, wherein said inlet surface has a curved surface.

16. The nozzle of claim 13, wherein said inlet surface has a shape similar to that of an airfoil.

17. An atomizing nozzle for creating fine droplets of liquid, said nozzle, comprising:

an outer frame;

a pintle comprising an inlet splash plate, a tapered shaft coupled to said inlet splash plate, and an outlet deflector plate coupled to said tapered shaft;

a liquid feed inlet positioned so that a stream of liquid exiting said liquid feed inlet strikes said splash plate;

a gas inlet disposed upstream of said splash plate; and at least one support spoke, having an inlet surface and an outlet surface, coupled to said outer frame and said inlet splash plate of said pintle, wherein said inlet surface of said support spoke is non-planar;

wherein said at least one support spoke is shaped to reduce the flow of liquid to said frame via said at least one support spoke.

18. The atomizing nozzle of claim 17, wherein said pintle is disposed axially within said outer frame, further wherein said outer frame has an inner surface forming a venturi.

19. The atomizing nozzle of claim 17, further comprising at least one dam disposed on said inlet surface of said at least one support spoke.

20. The atomizing nozzle of claim 19, wherein said inlet surface of said support spoke has a shape similar to that of an airfoil.

21. The atomizing nozzle of claim 19, wherein said inlet surface of said support spoke is angular.

22. The atomizing nozzle of claim 19, wherein said inlet surface of said support spoke has a curved surface.

23. An atomizing nozzle comprising:

an outer frame;

a pintle;

at least one support spoke, having an inlet surface and an outlet surface, coupled to said outer frame and said inlet splash plate of said pintle, wherein said inlet surface of said support spoke is non-planar;

a body;

a chamber defined within said body, wherein said chamber has a base and an outlet;

a liquid feed tube centrally aligned and extending longitudinally within the chamber for the introduction of a pressurized liquid directed towards said splash plate, said inlet tube having a discharge plane; and;

a gas inlet for admitting pressurized atomizing gas to the chamber, where gas from the gas inlet is discharged at a gas exit surface located between the base of the nozzle chamber and the discharge plane of the liquid inlet tube;

wherein said discharge plane of said liquid feed tube is a predetermined minimum distance from said inlet splash plate of said pintle wherein said at least one support spoke is shaped to reduce the flow of liquid to said frame along said at least one support spoke.

24. The atomizing nozzle of claim 23, wherein said inlet surface of said at least one support spoke is angular.

25. The atomizing nozzle of claim 23, wherein said inlet surface of said at least one support spoke has a shape similar to that of an airfoil.

26. The atomizing nozzle of claim 23, wherein said inlet surface of said at least one support spoke has a curved surface.

27. The atomizing nozzle of claim 23, further comprising at least one dam disposed on said inlet surface of said at least one support spoke.

28. The nozzle of claim 23 wherein said pintle comprises:

an inlet splash plate, a tapered shaft coupled to said inlet splash plate, and an outlet deflector plate coupled to said tapered shaft.

29. The nozzle of claim 28, wherein said pintle is disposed axially within said outer frame, and wherein said outer frame has an inner surface forming a venturi.

30. The nozzle of claim 29, wherein said inlet surface of said at least one support spoke is angular.

31. The nozzle of claim 29, wherein said inlet surface of said at least one support spoke has a shape similar to that of an airfoil.

32. The nozzle of claim 29, wherein said inlet surface of said at least one support spoke has a curved surface.

* * * * *